United States Patent [19]

Masuda

[11] Patent Number: 4,472,756

[45] Date of Patent: Sep. 18, 1984

[54] DUCT TYPE CHARGE ELIMINATOR

[76] Inventor: Senichi Masuda, No. 605, 1-40-10, Nishigahara, Kita-ku, Tokyo, Japan, 114

[21] Appl. No.: 421,729

[22] Filed: Sep. 23, 1982

[30] Foreign Application Priority Data

Sep. 30, 1981 [JP] Japan ..... 56-155419
Sep. 10, 1982 [JP] Japan ..... 57-157911

[51] Int. Cl.[3] ..... H05F 3/06

[52] U.S. Cl. ..... 361/212; 361/215; 361/220

[58] Field of Search ..... 361/212, 213, 215, 220, 361/226, 227, 229, 230, 231

[56] References Cited

U.S. PATENT DOCUMENTS 3,801,869 4/1974 Masuda ..... 361/227
4,029,995 6/1977 Itoh ..... 361/226

FOREIGN PATENT DOCUMENTS 4634868 3/1965 Japan ..... 361/212
577704 10/1977 U.S.S.R. ..... 361/215
577705 10/1977 U.S.S.R. ..... 361/215

*Primary Examiner*—Harry E. Moose, Jr.

*Attorney, Agent, or Firm*—Steinberg & Raskin

[57] ABSTRACT

At least one planar type plasma ion source is positioned in a main duct through which charged materials pass in a manner whereby its active surface producing plasma faces the flow channel of charged materials inside the duct. The plasma ion source has at least one dielectric sheet, at least one corona electrode in operative proximity with one surface of the dielectric sheet and at least one planar type exciting electrode affixed to the opposite surface of the dielectric sheet and covering the entire area facing the corona electrode. A high voltage AC power supply energizes the plasma ion source by producing a high AC voltage and being connected to apply the voltage between the corona and the exciting electrode across the dielectric sheet whereby AC surface coronas serving as an active planar type plasma containing copious positive and negative ions are produced by the corona electrode along the one surface of the dielectric sheet and charged materials entering the flow channel inside the duct are bombarded by ions of opposite polarity from the plasma and are rapidly neutralized in charge during passage through the flow channel.

15 Claims, 11 Drawing Figures

DUCT TYPE CHARGE ELIMINATOR

BACKGROUND OF THE INVENTION

The present invention relates to a duct type charge eliminator for elimination of electric charge carried by charged materials, such as dust particles, granular particles, grains, low conductivity liquids, etc., strongly charged by friction in the course of conveyance through a pipe or duct. The duct type charge eliminator of the invention may be connected to the pipeline or duct for conveying these materials, so that the charge of such materials may be quickly neutralized by passing through said charge eliminator.

It is well known that various kinds of high resistivity powders, such as, for example, resin powders to be used for electrostatic powder coating, resin pellets, grains, ceramic powders, and also a number of low conductivity liquids, such as, for example, pure hydrocarbon liquids, fuels, etc., are highly charged during the course of transport through a pipe-line or duct. As a result, these strongly charged materials often cause a fire or explosion in the tank at the terminal of the pipe-line or duct due to the ignition induced by a spark produced by the electric charge of said materials. In other cases, the strongly charged powders or pellets deposit on the inner wall of the pipe-line or duct, as a result of the electrostatic attractive force and disturb the transport of the material. The reentrained flakes often produce a degradation of the finished coat of the powder coating.

However, there has been no charge eliminating apparatus to be used in the pipe-line or duct, and the only possible countermeasure for the aforedescribed charge-induced hazards or nuisance has been to use the conventional type charge eliminator at the outlet of the pipe-line. This often produced poor elimination performance, and a high cost of charge elimination. In many cases, it was almost impossible to attach the charge eliminator at the outlet of the pipe-line because of space limitation, the construction of the tank, safety problems of the tank, etc.

SUMMARY OF THE INVENTION

The principal object of the invention is to provide a duct type charge eliminator which may be connected at any desired position in a pipe-line or duct.

An object of the invention is to provide a duct type charge eliminator which may be connected at any desired position in a pipe-line or duct to permit passage of materials and eliminate the charge of such materials.

Another object of the invention is to provide a duct type charge eliminator which may be connected at any desired position in a pipe-line or duct and eliminates the charge of materials passing through such pipe-line or duct in the short time that such materials pass through the charge eliminator.

The duct type charge eliminator of the invention attains these objects by incorporating a planar type plasma ion source or sources in a duct, in such a way that the active surfaces of said source which produce the planar type plasma containing copious positive and negative ions face the flow of the charged materials inside the duct. This provides the charged materials with ions of the opposite polarity to effectively neutralize their charge. The planar type plasma ion source of the invention is a device for producing AC surface corona discharge by a corona electrode or electrodes attached to a surface of a dielectric sheet. A planar type exciting electrode is affixed to the other surface of the dielectric sheet. Both electrodes have a high AC voltage applied across the dielectric sheet.

The duct type charge eliminator of the invention consists of a main duct through which the charged materials are allowed to pass. At least one planar type plasma ion source is positioned inside the main duct in such a way that its active plasma-producing surface faces the flow channel of the charged materials inside the main duct. A high AC voltage source energizes the planar type plasma ion source. The planar type plasma ion source consists of at least one dielectric sheet, a corona electrode or electrodes affixed to, or close to one surface of, the dielectric sheet, and at least one planar type exciting electrode affixed to the opposite surface of the dielectric sheet. A high AC voltage from the high voltage AC source is applied between the corona and exciting electrodes across the dielectric sheet, so that AC surface corona discharge is produced as a planar type plasma containing copious positive and negative ions by the corona electrode or electrodes along the active surface of the dielectric sheet.

Here, the planar type configuration of the plasma ion source of the charge eliminator includes not only a flat surface configuration, but also any type of curved surface configuration, such as, for example, a cylindrical surface, a polygonal surface, etc.

The planar type dielectric sheet of the planar type plasma ion source may comprise any type of dielectric material, organic or inorganic. However, the most preferred materials are the corona-resistant inorganic dielectric materials, such as, for example, glass, ceramics, mica, etc.

The corona electrode of the planar type plasma ion source may comprise any type of corona-resistant metal, including stainless steel, tungsten, platinum, nickel, etc., in the form of a thin wire or narrow thin strip. The corona electrode may be affixed to the surface of the planar type dielectric sheet mechanically at both its ends, or by a suitable adhesive. The most preferred way of producing the corona electrode is to make a pattern of the electrode by thick film printing technology using an ink containing powders of tungsten, silver or other suitable metal, on the surface of the dielectric sheet. The sheet is then baked at an elevated temperature to sinter the printed pattern of the corona electrode to form its final pattern firmly attached on the surface.

The planar type exciting electrode attached to the opposite surface of the planar type dielectric sheet may comprise a suitable thin metal foil or sheet, such as, for example, aluminum foil, affixed to such surface by an adhesive. Preferably, however, it is formed by a conductive paint, or thick film printing technology, or thin film technology, by deposition of metal vapor on the surface using a sputtering method. In some cases, it is necessary for safety to cover the entire portion of the exciting electrode with an insulation sheet affixed to the opposite surface of the dielectric sheet.

The high AC voltage may have any suitable waveform, including sinusoidal, pulsive, pulsating, and other waveforms. Its frequency may be any suitable value ranging from a commercial frequency up to a high frequency. The preferred frequency, however, is beyond 1 kHz, since the plasma becomes more stable and uniform in this case.

The main duct may be a metal duct having a cross-section of any shape, including circular or rectangular. The duct may be made of any suitable material, including plastic material, fiber-reinforced plastic, rubber, cement-mixed rubber, glass, or ceramic.

When there is a dust deposit on the active surface of the plasma ion source to hamper its production of surface AC corona, it is possible to incorporate in the main duct a suitable device to remove the dust deposit. Such a device may comprise a moving mechanical scraper having nozzles for supplying strong air jets for blowing off the dust deposit, or a mechanical rapping device or magnetic vibrator affixed to the outside of the main duct to provide a mechanical shock for removing the dust. Movable type corona electrodes may be mounted on the surface of the plasma ion source. Such electrodes slide on the surface to scrape off the dust deposit.

In such cases, it is preferable to make the side wall of the main duct of a construction which enables it to easily be opened in a form of a hinged door, or dismounted for an inspection and cleaning of its inside.

When necessary, it is possible to provide flanges or other suitable connecting devices at both ends of the main duct to facilitate its connection to the pipe-line.

BRIEF DESCRIPTION OF THE DRAWINGS

For a fuller understanding of the invention, reference is had to the following description, taken in connection with the accompanying drawings, in which.

DESCRIPTION OF PREFERRED EMBODIMENTS

Figure 1:
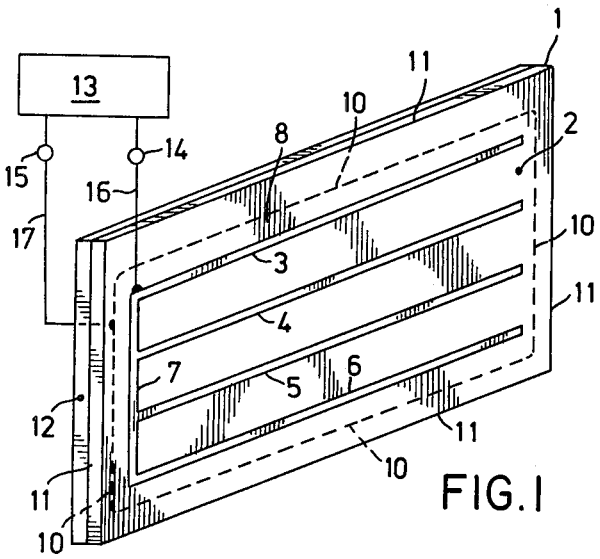
FIG. 1 is a perspective view of a first embodiment of the plasma ion source of the duct type charge eliminator of the invention.
Figure 2:
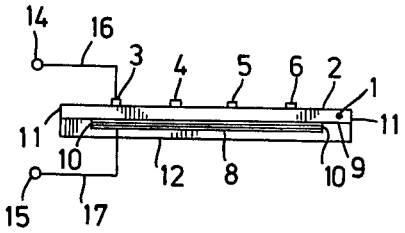
FIG. 2 is a cross-sectional view of the embodiment of FIG. 1.

FIG. 1 is a perspective view of a first embodiment of the planar type plasma ion of the duct type charge eliminator of the invention and FIG. 2 is its vertical cross-section. A rectangular sheet or plate 1 is an inorganic dielectric sheet, such as, for example, high purity alumina ceramic or heat-resistant glass. Strip-like corona electrodes 3, 4, 5 and 6, of 1 mm width and 100 micrometer thickness, are formed on the surface 2 of the dielectric sheet 1 by thick film printing technology and sintered thereafter, and connected to a common connecting conductor 7 formed by the same thick film printing technology and sintering. A planar type exciting electrode 8 is affixed to the opposite surface 9 of the dielectric sheet 1, covering the entire area facing to the corona electrodes 3 to 6 affixed to the opposite surface 2, with its periphery 10 lying at least 3 to 5 mm inside the peripheral lines 11 of said dielectric sheet. The exciting electrode 8 may be formed again by thick film printing technology in combination with sintering, and its thickness is 10 micrometers, in this case.

An insulating layer 12 covers the back sides of both the exciting electrode 8 and the dielectric sheet 1, for securing the safety thereof. The layer 12 may be a plastic resin layer, a fiber-reinforced, or FRP, plastic layer, a glass or a ceramic plate, affixed to the electrode 8 and the surface 9 by a suitable adhesive. It is also possible to use a high purity alumina plate, which is laminated on the back side of the high purity alumina sheet 1, covering the exciting electrode 8, printed thereon, in the stage before sintering of the sheet 1, the electrode 8 and the layer 12, and sintered together to construct the planar type plasma ion source as an integrated entity. A high AC voltage power supply 13 applies electrical energy between the corona electrodes 3 to 6 and the exciting electrode 8, across the dielectric sheet 1, through terminals 14 and 15 and wires 16 and 17. This produces AC surface coronas from the corona electrodes along the surface 2 of the dielectric sheet 1. These AC surface coronas serve as the planar type plasma ion source, containing copious positive and negative ions, formed on the surface 2 of the dielectric sheet 1.

Figure 3:
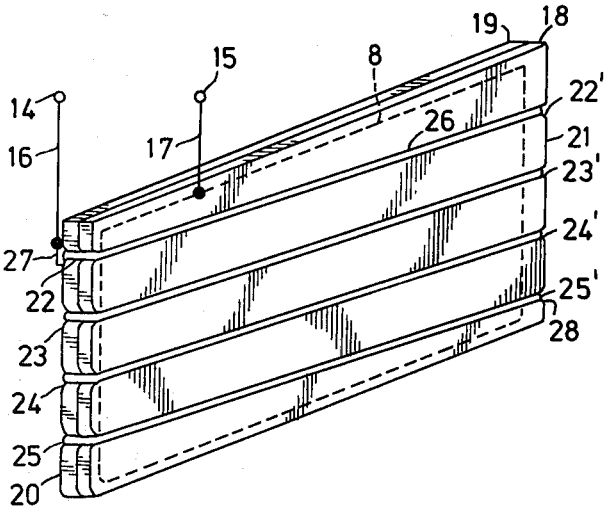
FIG. 3 is a perspective view of a second embodiment of the plasma ion source of the duct type charge eliminator of the invention.

FIG. 3 shows another embodiment of the planar type plasma ion source perspective. Two rectangular planar type dielectric sheets 18 and 19, laminated on both sides of the planar type exciting electrode 8, covering its entire area, are firmly affixed to each other using a suitable adhesive. When both sheets 18 and 19 are high purity alumina plate, they may be laminated on each other, containing the thick film printed exciting electrode 8 inside, in the stage before sintering, and then sintered together to form an integrated entity. Slits 22, 23, 24, 25 and 22', 23', 24', 25', spaced at a constant distance, are formed in both sides 20 and 21 of the planar type dielectric sheets 18 and 19, respectively. A single thin tungsten wire 26 is wound around the dielectric sheets 18 and 19, as an integral plate, so that at both sides 20 and 21, said wire is in biting contact with said sheets at the slits 22 to 25 and 22' to 25'. The wire 26 is affixed to the integral plate at both ends 27 and 28, thereby forming a wire-like corona electrode affixed to the outer surfaces of the dielectric sheets 18 and 19, spaced at a constant distance and arranged in parallel with each other. When a high AC voltage is applied via the terminals 14 and 15 and the wires 16 and 17 between the wire-like corona electrode 26 and and the exciting electrode 8 across the two dielectric sheets 18 and 19, planar type plasma is produced by the AC surface coronas from said wire-like corona electrode 26 at the outer surfaces of each of the dielectric sheets 18 and 19.

Figure 4:
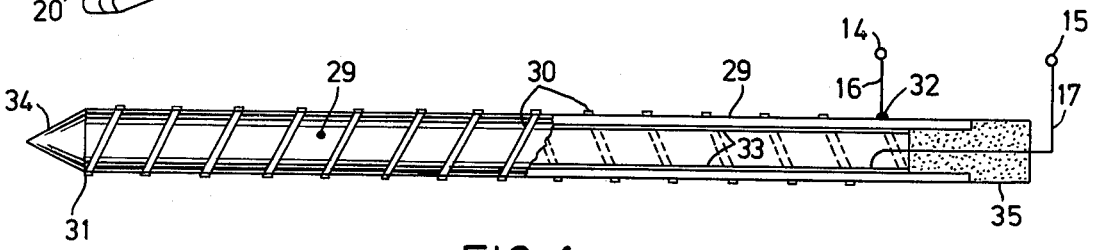
FIG. 4 is a view, partly cut away and partly in section, of a third embodiment of the plasma ion source of the duct type charge eliminator of the invention.

FIG. 4 shows a side view of another embodiment of the plasma ion source. A cylindrical dielectric 29 comprises heat-resistant glass or ceramic, having a helical strip-like corona electrode 30 wound around its outer surface and affixed to said dielectric at both ends 31 and 32. A planar type exciting electrode 33 comprises a conducting paint film painted on the inner surface of the cylindrical dielectric 29. An insulator cone 34 is attached to the upstream end of the cylindrical dielectric 29 to prevent dust deposition thereon. An insulator bushing 35 is affixed to the downstream end of the dielectric 29. The connecting wire 17 from the terminal 15 passes through the bushing 35 to come into contact with the surface of the exciting electrode 33. When a high AC voltage is applied through the terminals 14 and 15 and the wires 16 and 17 between the helical corona electrode 30 and the exciting electrode 33, across the cylindrical dielectric 29, plasma in the form of a cylindrical surface is produced on the entire outer surface of said cylindrical dielectric.

Figure 5:
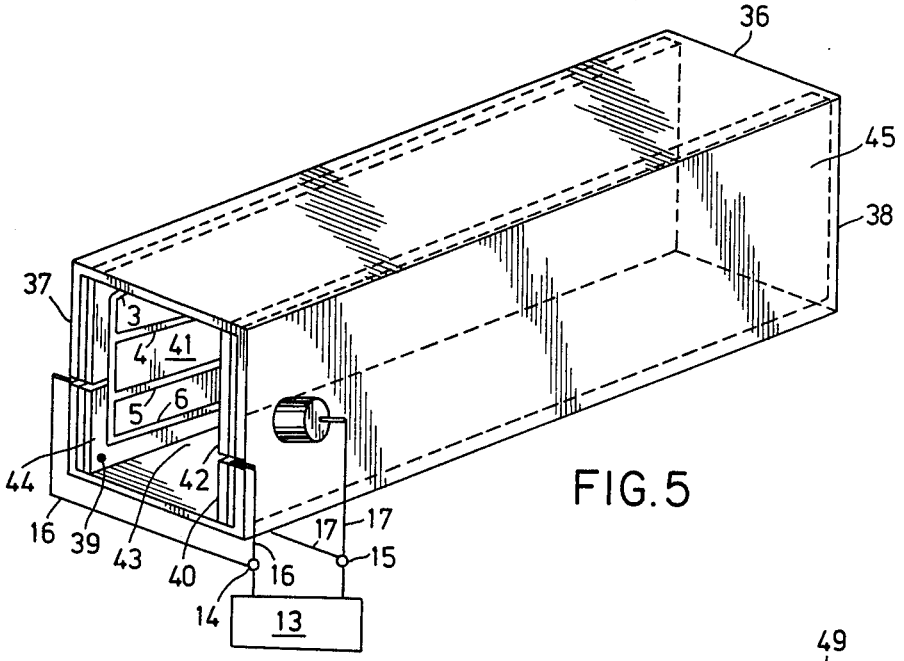
FIG. 5 is a perspective view of a first embodiment of the duct type charge eliminator of the invention, utilizing a pair of the plasma ion sources of FIGS. 1 and 2.

FIG. 5 illustrates a first embodiment of the duct type charge eliminator of the invention in perspective. A main duct 36 has a rectangular cross-section. Rectangular planar type plasma ion sources 39 and 40 (FIG. 1) are affixed to the inner surfaces of a pair of opposite sides 37 and 38 of the main duct 36. The active surfaces 41 and 42 of the plasma ion sources 39 and 40 comprise the corona electrodes for the production of plasma facing the main flow channel 43 inside the main duct 36. When a high AC voltage from the power supply 13 is applied via the terminals 14 and 15 and the wires 16 and 17, between the corona electrodes 3 to 6 of each plasma ion source and its exciting electrode 8 across its dielectric sheet 1, active planar type plasmas are produced on the active surfaces 41 and 42 of the planar type plasma ion sources 39 and 40. When the main duct 36 of the present charge eliminator is connected to a pipe-line carrying the charged materials so that they are introduced into the main duct from its inlet 44 to pass through its inner main flow channel 43, the charge of these materials is rapidly neutralized and eliminated by the ions of the opposite polarity supplied from the plasma produced at the active surfaces 41 and 42 of the plasma ion sources 30 and 40. After charge elimination, the materials are supplied from the outlet 45 of the main duct 36 to the downstream pipe-line.

It is possible, when necessary, to incorporate another two planar type plasma ion sources affixed to the inner surfaces of the upper and lower side walls of the main duct 36, thereby forming planar type plasmas on the entire inner surface of said duct.

Figure 6:
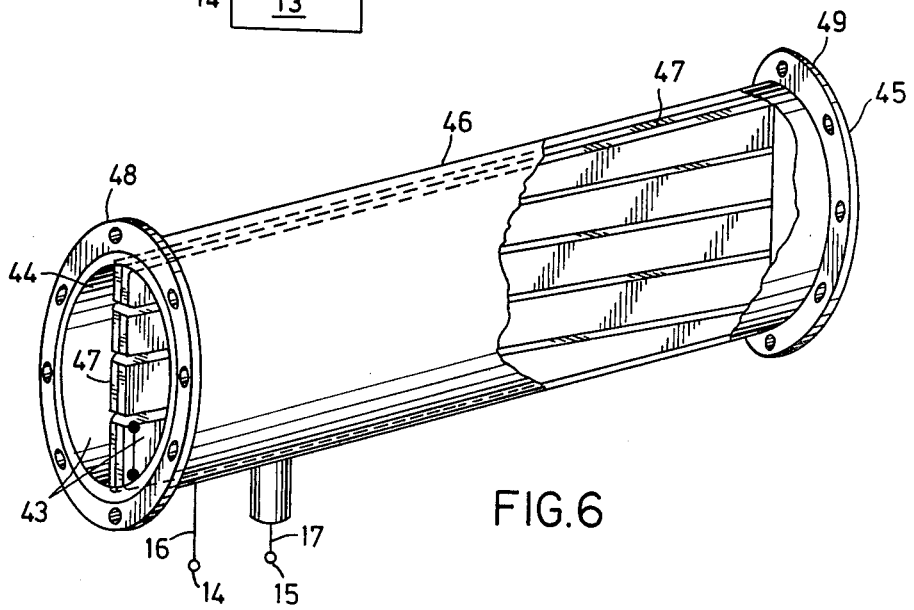
FIG. 6 is a perspective view, partly cut away, of a second embodiment of the duct type charge eliminator of the invention, utilizing the plasma ion source of FIG. 3.

FIG. 6 shows another embodiment of the charge eliminator of the invention in perspective. A cylindrical main duct 46 incorporates a planar type plasma ion source 47 (FIG. 3) therewithin, located along its major cross-section along its axis and dividing its inner main flow channel 43 into two parts having equal semicircular cross-sections. When the main duct 46 is connected in the pipe-line with its upstream and downstream flanges 48 and 49, the charged materials enter into the two main flow channels 43 and their charges are neutralized by the planar type plasma produced on both sides of the planar type plasma ion source 47, so that they are supplied, after charge elimination, to the upstream side of the pipe-line from the outlet 45.

Figure 7:
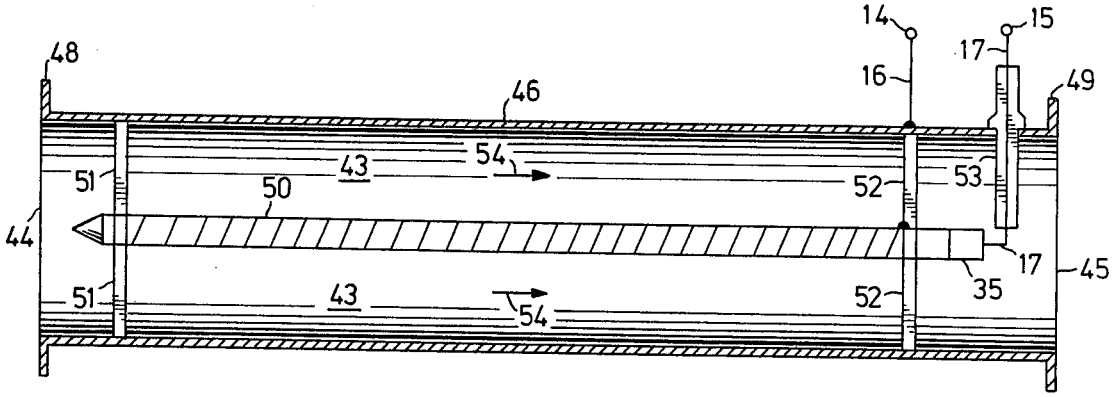
FIG. 7 is a view, partly in section, of a third embodiment of the duct type charge eliminator of the invention, utilizing the plasma ion source of FIG. 4.

FIG. 7 shows another embodiment of the charge eliminator of the invention in cross-sectional view. The cylindrical main body 46 has its inlet and outlet 44 and 45, and its inlet flange and outlet flanges 48 and 49. The cylindrical plasma ion source 50 (FIG. 4) is located along the axis of the cylindrical main duct 46 and is supported by two metal supporting members 51 and 52, at its upstream and downstream ends, affixed to the inner wall of said main duct. The terminal 14 is connected to the helical wire-like corona electrode 30 at its downstream end 32 via the wire 16 and the metal supporting member 52. The terminal 15 is connected to the exciting electrode 33, affixed to the inner surface of the cylindrical plasma ion source 50 via the wire 17, an insulator bushing 53 passing through the main duct 46, and the insulator bushing 35, affixed to the downstream end of said cylindrical plasma ion source 50. When a high AC voltage is applied from the terminals 14 and 15 between the helical corona electrode 30 and the exciting electrode 33, across the cylindrical dielectric 29, an active plasma in a form of a cylindrical plane is produced around the cylindrical plasma ion source 50 along its entire outer surface. The charged materials entering into the main flow channel 43 in the direction of an arrow 54 are neutralized in charge by the ions of the opposite polarity supplied from the plasma ion source.

Figure 8:
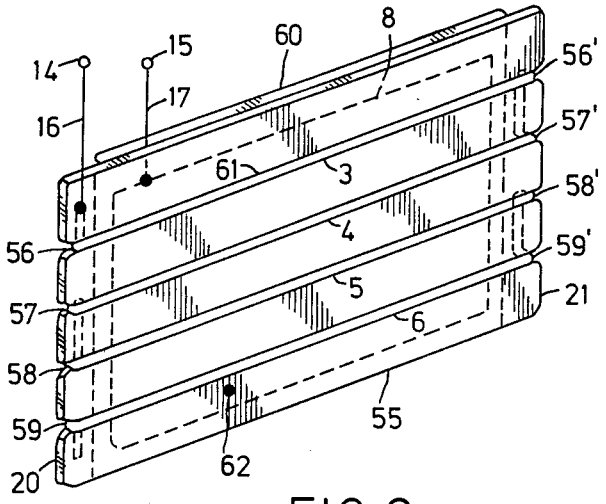
FIG. 8 is a perspective view of a fourth embodiment of the plasma ion source of the duct type charge eliminator of the invention.
Figure 9:
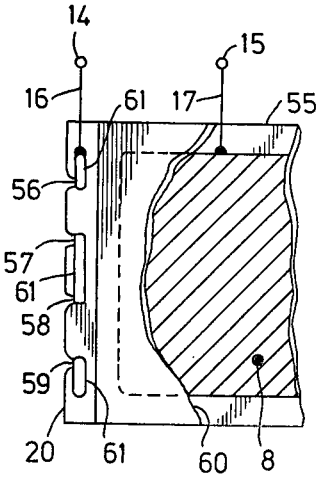
FIG. 9 is a view, partly cut away and partly in section, of part of the embodiment of FIG. 8.

FIG. 8 illustrates another embodiment of the rectangular planar type plasma ion source of the charge eliminator of the invention. The embodiment of FIG. 8 is a modification of the plasma ion source of FIG. 1. FIG. 9 is a cut away view of an end portion of the plasma ion source of FIG. 8. A rectangular planar type dielectric sheet 55 has a planar type exciting electrode 8 affixed to its back side. Both ends of the dielectric sheet 55 have deep slits 56, 57, 58, 59 and 56', 57', 58' and 59', respectively, formed therein. An insulating layer 60 is affixed to the back sides of both the planar type dielectric sheet 55 and the exciting electrode 8, covering their entire back surfaces for safety purposes. The portions of the planar type dielectric sheet at both ends having the deep slits are not covered by the insulating layer 60.

A single wire-like or strip-like corona electrode 61 is affixed at its one end, in a position close to the slit 56, to the back side of the dielectric sheet 55. The corona electrode 61 is spanned on the surface 62 to produce the parallel wire-like corona electrodes 3, 4, 5 and 6, spaced at equal distances, in a manner whereby said single wire electrode is affixed at both its ends 20 and 21, successively, in a biting contact followed by 90 degree rotation in the slits 56, 56', 57', 57, 58, 58', 59', 59, as shown in detail in FIGS. 8 and 9. When a high AC voltage is applied via the terminals 14 and 15, the wires 16 and 17, between the corona electrodes, 3 to 6 and the exciting electrode 8, across the rectangular planar type dielectric sheet 55, a planar type plasma is produced on the surface 62 of said dielectric sheet.

The rectangular planar type plasma ion sources shown in FIGS. 1 and 8 may also be incorporated in a cylindrical main duct, so that they cover its inner surface, partially or totally. It is also possible to incorporate one or more of the plasma ion sources shown in FIGS. 3 and 4 in main ducts of either rectangular or cylindrical configuration.

Figure 10:
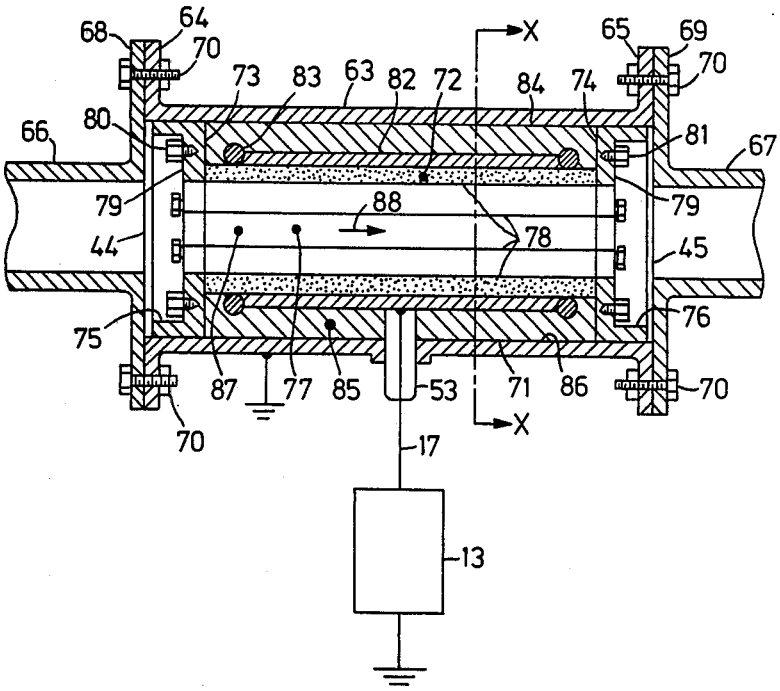
FIG. 10 is a cross-sectional view of a fourth embodiment of the duct charge eliminator of the invention.
Figure 11:
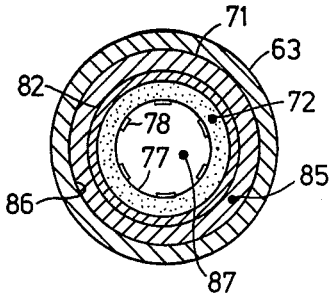
FIG. 11 is a cross-sectional view, taken along the lines XI—XI, of FIG. 10.

FIG. 10 shows another embodiment of the duct type charge eliminator of the invention, utilizing another embodiment of a plasma ion source, and FIG. 11 is a vertical cross-section of FIG. 10. A cylindrical main duct 63 has at its inlet and outlet 44 and 45 an inlet flange 64 and an outlet flange 65, connected to the upstream and downstream pipe-lines 66 and 67, respectively, via flanges 68 and 69, respectively, via bolts and nuts 70. A cylindrical plasma ion source 71 is inserted into the cylindrical main duct 63 and comprises a cylindrical dielectric 72 consisting of a glass or ceramic cylinder having annular metal rings 73 and 74 at both its ends. The rings 73 and 74 have circular walls 75 and 76, respectively. Wire-like corona electrodes 78 are affixed to the inner surface 77 of the cylindrical dielectric 72. The wire-like corona electrodes 78 are spaced at an equal distance in parallel with each other and with the axis of the cylindrical dielectric 72. The corona wire electrodes 78 consist originally of a single metal wire 79 spanned on the surface 77 between both ends of the cylindrical dielectric 72 in a zig-zag fashion. The wire 79 is affixed by bolts 80 and 81 at the equally spaced positions on the annular metal rings 73 and 74 and are in electrical contact with the grounded metal main duct 63.

An exciting electrode 82 is affixed to the outer surface of the cylindrical dielectric 72. The exciting electrode 82 consists of conductive paint film and has two rings 83 and 84 at both its ends serving as corona-prevention rings via their field relaxation action. Both rings 83 and 84 are located inside both ends of the cylindrical dielectric 72 at a distance of about 5 to 10 mm. The outer surface of the exciting electrode 82, the two rings 83 and 84, and the remaining portions of the outer surface of the cylindrical dielectric 82 at its ends are all embedded in an insulating plastic mold 85. The mold 85 has an outer diameter equal to that of the two annular metal rings 73 and 74, and slightly smaller than the inner diameter of the cylindrical main duct 63, so that the cylinder shaped plasma ion source may be freely inserted into said duct by sliding motion. The outer surface of the plastic mold 85 is covered by a conductive film 86 of conductive paint, so that no corona occurs between the outer surface and the inner surface of the main duct 63.

The high AC voltage power supply 13 has one grounded output terminal and another terminal connected via the wire 17 and the insulating bushing 53, passing through the wall of the main duct 63 to the exciting electrode 82, so that a high AC voltage is applied across the cylindrical dielectric 72 between the wire-like corona electrodes 78 and said exciting electrode. Plasma is produced as surface corona on the entire inner surface 77 of the cylindrical dielectric 72. The charged materials entering from the upstream pipe-line 66 into the inside 87 of the cylindrical dielectric 72, which represents the main flow channel in this embodiment of the charge eliminator, pass through it in the arrow direction 88 to be rapidly neutralized in their charge by the ions of the opposite polarity from the cylindrical plasma. The materials are then supplied in neutralized condition to the downstream pipe-line 67 via the outlet 45.

In all the embodiments of the invention, the corona electrodes may be grounded with the exciting electrode being isolated, or the exciting electrode may be grounded with the corona electrodes being insulated, according to each different situation of the pipe-line, for the best safety precautions.

It has been determined that when extremely high resistivity charged materials are encountered only their faces directed to the plasma may be effectively neutralized in charge by bombardment of ions therefrom, but not their faces in the opposite direction. In this case, it is preferable to incorporate at the inlet of the present duct type charge eliminator a suitable agitating device for providing the flowing charged materials with a swirling motion. An agitating device may comprise fixed turbine blades, a rotating wheel, fixed skewed plates, etc., so that the charged materials undergo a violent turbulent motion inside the main flow channel of the duct type charge eliminator.

It is further preferable to construct the charge eliminator as a modular unit, which may be used in series in plurality, when necessary. In this case, the agitating device is located at the inlet of each modular unit of the duct type charge eliminator.

The principal components of the duct type charge eliminator of the invention are:

The dielectric sheets 1, 18, 19, 29, 55 and 72.
The corona electrodes 3, 4, 5, 6, 26, 30, 61, 78 and 79.
The planar type exciting electrodes 8, 33 and 82.
The insulating layers for safety 12, 60 and 85.
The high voltage AC power supply 13.
The terminals 14 and 15.
The connecting wires 16 and 17.
The main ducts 36, 46 and 63.
The inlet 44.
The outlet 45.
The planar type plasma ion sources 39, 40, 47, 50 and 71.
The flanges 48 and 49.
The flow channels 43 and 87.
The slits 22, 23, 24, 25, 22', 23', 24', 25', 56, 57, 58, 59, 56', 57', 58' and 59'.
The insulator bushings 35 and 53.
The annular metal rings 73 and 74.
The screw bolts 80.
The corona-avoiding rings 83 and 84.

The invention is by no means restricted to the aforementioned details which are described only as examples; they may vary within the framework of the invention, as defined in the following claims.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A duct type charge eliminator having a main duct through which charged materials pass, said charge eliminator comprising at least one planar type plasma ion source positioned in the duct in a manner whereby its active surface producing plasma faces the flow channel of charged materials inside said duct, said plasma ion source having at least one dielectric sheet, at least one corona electrode in operative proximity with one surface of said dielectric sheet and at least one planar type exciting electrode affixed to the opposite surface of said dielectric sheet and covering the entire area facing said corona electrode; and a high voltage AC power supply for energizing said plasma ion source, said power supply producing a high AC voltage and being connected to apply said voltage between said corona and said exciting electrode across said dielectric sheet whereby AC surface coronas serving as an active planar type plasma containing copious positive and negative ions are produced by said corona electrode along said one surface of said dielectric sheet and charged materials entering said flow channel inside said duct are bombarded by ions of opposite polarity from said plasma and are rapidly neutralized in charge during passage through said flow channel.

2. A duct type charge eliminator as claimed in claim 1, wherein said dielectric sheet of said plasma ion source is of rectangular configuration and is affixed to an inner surface of said main duct.

3. A duct type charge eliminator as claimed in claim 1, wherein said plasma ion source comprises two rectangular planar type dielectric sheets laminated to each other with said exciting electrode therebetween and said corona electrode is affixed to the outer surfaces of said dielectric sheets to provide an active plasma-producing surface on both sides of said plasma ion source, said plasma ion source being positioned in said flow channel of said duct in parallel therewith.

4. A duct type charge eliminator as claimed in claim 1, wherein said plasma ion source comprises a cylindrical dielectric having a plasma producing active cylindrical outer surface, said corona electrode being in operative proximity with said outer surface of said dielectric and said exciting electrode comprising an electrically conductive film on the inner surface of said dielectric, whereby surface coronas serving as plasma are produced on the entire outer surface of said dielectric, said plasma ion source being positioned in said flow channel in said duct in parallel therewith.

5. A duct type charge eliminator as claimed in claim 1, wherein said plasma ion source is of a cylindrical configuration having a plasma producing active cylindrical inner surface, said plasma ion source being affixed to an inside surface of said duct to form said flow channel inside said plasma ion source, said dielectric being of a cylindrical configuration, said corona electrode being in operative proximity with the inner surface of said dielectric, and said exciting electrode being an electrically conductive film on the outer surface of said dielectric, whereby surface coronas serving as plasma are produced on the entire inner surface of said dielectric.

6. A duct type charge eliminator as claimed in claim 1, further comprising an insulating layer entirely covering the surface of said exciting electrode opposite that affixed to said dielectric sheet, said insulating layer being affixed to said opposite surface of said dielectric sheet whereby said exciting electrode, even at high potential, is isolated from its surroundings for safety reasons.

7. A duct type charge eliminator as claimed in claim 1, wherein said dielectric sheet comprises inorganic material of the group consisting of glass and ceramics.

8. A duct type charge eliminator as claimed in claim 1, wherein said corona electrode comprises a thin wire-like electrically conductive film affixed to said dielectric sheet.

9. A duct type charge eliminator as claimed in claim 1, wherein said high voltage AC power supply provides a high voltage having a frequency greater than 1 kHz.

10. A duct type charge eliminator as claimed in claim 1, wherein said high voltage AC power supply provides a high voltage having a commercial frequency.

11. A duct type charge eliminator as claimed in claim 1, wherein said high voltage AC power supply provides a pulsed high voltage.

12. A duct type charge eliminator as claimed in claim 1, wherein said duct has flanges at its opposite ends for connection to a pipe-line through which the charged materials flow.

13. A duct type charge eliminator as claimed in claim 1, wherein said duct has a side wall of a construction permitting easy opening for inspection and maintenance of the said plasma ion source located therein.

14. A duct type charge eliminator as claimed in claim 1, wherein said duct has an inlet and an outlet and further comprising agitating means for agitating charged material at the inlet of said duct in order to provide charged material flowing therethrough with a swirling motion.

15. A duct type charge eliminator as claimed in claim 1, further comprising cleaning means for removing deposited dust from said one surface of said plasma ion source.

* * * * *